US010154723B2

(12) United States Patent
Kreutzer

(10) Patent No.: US 10,154,723 B2
(45) Date of Patent: Dec. 18, 2018

(54) GOLF BAG HYDRATION SYSTEM AND MULTI-ACCESSORY UNIT

(71) Applicant: Mark Kreutzer, Sandy, UT (US)

(72) Inventor: Mark Kreutzer, Sandy, UT (US)

( * ) Notice: Subject to any disclaimer, the term of this patent is extended or adjusted under 35 U.S.C. 154(b) by 0 days.

(21) Appl. No.: 14/704,862

(22) Filed: May 5, 2015

(65) Prior Publication Data

US 2015/0320187 A1 Nov. 12, 2015

Related U.S. Application Data

(60) Provisional application No. 61/989,839, filed on May 7, 2014.

(51) Int. Cl.

| | |
|---|---|
| ***A45F 3/20*** | (2006.01) |
| *A45F 3/00* | (2006.01) |
| *A63B 55/00* | (2015.01) |

(52) U.S. Cl.

CPC ..... *A45F 3/20* (2013.01); *A63B 55/408* (2015.10); *A45F 2003/003* (2013.01); *A63B 55/00* (2013.01); *A63B 2225/682* (2013.01)

(58) Field of Classification Search

CPC ..... A45F 2003/003; A45F 2003/166; A45F 2200/0516; A45F 3/20; A45F 3/04; A45F 5/00; A45F 3/18; A63B 55/00; A63B 55/408; A63B 55/404; A63B 55/406; A63B 57/00; A63B 2225/682; B62J 11/00; B65D 35/00

USPC ..... 222/92–107, 146.6, 526–537, 175, 222/608–610; 190/110, 120; 206/38, 206/315.1, 315.3, 315.5; 224/148.1–148.8, 274, 414, 933, 901.8

See application file for complete search history.

(56) References Cited

U.S. PATENT DOCUMENTS

| | | | | |
|---|---|---|---|---|
| 2,521,573 | A * | 9/1950 | Filler | A63B 55/00 206/217 |
| 3,128,812 | A | 4/1964 | Scheurer | |
| 3,638,284 | A | 2/1972 | Baker | |
| 4,095,812 | A * | 6/1978 | Rowe | B62J 11/00 222/175 |
| 4,274,566 | A * | 6/1981 | Rowe | B62J 11/00 222/610 |
| 4,282,912 | A | 8/1981 | Brown | |
| 4,350,194 | A * | 9/1982 | Brown | A63B 55/00 206/315.5 |
| 4,420,097 | A * | 12/1983 | Motsenbocker | A45F 3/16 222/131 |
| 4,625,862 | A | 12/1986 | Clayton | |
| 4,689,897 | A | 9/1987 | Marsalona | |
| 4,924,682 | A | 5/1990 | Penner | |
| 4,984,684 | A | 1/1991 | Conner et al. | |
| 5,042,702 | A | 8/1991 | Douglass | |

(Continued)

*Primary Examiner* — Nicholas J Weiss
*Assistant Examiner* — Andrew P Bainbridge
(74) *Attorney, Agent, or Firm* — Durham Jones & Pinegar; Randall B. Bateman; Sarah W. Matthews

(57) ABSTRACT

A golf bag hydration system includes a hydration bladder and a length of tubing for carrying liquid from the hydration pack to a remote location. The golf bag hydration system may include a storage pack for holding of the tubing. The storage pack may include attachment members for mounting on the golf bag. The hydration system may also include a guide or sleeve for holding a distal end of the tubing for holding the tubing to a shoulder strap or handcart associated with a golf bag.

24 Claims, 9 Drawing Sheets

(56) References Cited

U.S. PATENT DOCUMENTS 5,096,059 A * 3/1992 Henderson ..... A63B 55/408 206/315.3
5,105,958 A * 4/1992 Patton ..... A45F 3/16 215/14
5,177,881 A * 1/1993 Moore ..... A63B 55/408 206/315.3
5,301,858 A * 4/1994 Hollander ..... B62J 11/00 224/148.2
5,358,142 A * 10/1994 Holmes ..... B62J 99/00 222/1
5,400,934 A * 3/1995 Ducros ..... A45F 3/04 128/202.15
5,564,605 A * 10/1996 Heidbreder ..... A63B 55/00 222/192
5,645,404 A * 7/1997 Zelenak ..... A45F 3/16 222/175
5,722,573 A 3/1998 Camel
6,220,490 B1 * 4/2001 O'Hara ..... A45F 3/16 2/102
6,415,960 B1 * 7/2002 Fink ..... B67D 3/00 222/175
6,499,593 B1 12/2002 Uner et al.
6,598,770 B2 * 7/2003 Bolts ..... A45F 3/00 224/148.2
6,666,360 B1 * 12/2003 Swank ..... A45F 3/20 222/175
6,908,015 B2 * 6/2005 Choi ..... F16L 37/0841 128/203.21
7,175,059 B2 * 2/2007 Copich ..... A45F 3/20 224/148.2
7,293,677 B2 11/2007 Wempe et al.
7,552,734 B2 * 6/2009 Adams ..... A01K 7/00 128/847
8,136,702 B2 * 3/2012 Skillern ..... A45F 3/20 220/703
8,322,156 B2 * 12/2012 Searle ..... A41D 13/0025 62/259.3
8,604,392 B1 * 12/2013 Ostrom ..... A45F 3/20 219/214
9,155,375 B2 * 10/2015 Murrey ..... A45F 3/20
9,545,549 B2 * 1/2017 Soracco ..... A63B 71/0619
2003/0019766 A1 1/2003 Jung
2003/0094390 A1 5/2003 Thompson et al.
2007/0267454 A1 * 11/2007 Baiz ..... A45C 5/06 224/576
2008/0047857 A1 * 2/2008 Blumenkrantz ..... A63B 55/00 206/315.5
2008/0217367 A1 * 9/2008 Lillie ..... A45F 3/047 224/148.2
2009/0050247 A1 * 2/2009 Light ..... A63B 57/60 150/160
2009/0179046 A1 * 7/2009 Reichert ..... A45F 3/20 222/95
2009/0236378 A1 * 9/2009 Crye ..... A45F 3/14 224/148.2
2010/0072232 A1 * 3/2010 Rider ..... B62J 11/00 222/610
2011/0192785 A1 * 8/2011 Pritchard ..... A45F 3/14 210/419
2013/0161350 A1 * 6/2013 Murrieta ..... A61J 7/0053 222/105
2013/0186906 A1 * 7/2013 Underhill ..... A45F 3/16 220/705
2013/0214001 A1 * 8/2013 Katz ..... A45F 3/20 222/95
2014/0013481 A1 * 1/2014 Lee ..... A41D 15/04 2/69

* cited by examiner 18
54b
74
74
22''''
54a
74
74

18
54d
74
74
22''''
54c
74
74

18
74
54d
74
22''''
54a
74
74

54b
22''''
18
74
74
54c 18
54b
54d
74
74
22''''
74

74
22''''
74
54c
54a
18

GOLF BAG HYDRATION SYSTEM AND MULTI-ACCESSORY UNIT

BACKGROUND

1. Field of the Invention

The present invention relates to a hydration system and multi-accessory unit. More particularly, the present invention relates to a hydration management system and multi-accessory unit which may be removably attached to a golf bag or the like and removed therefrom when desired.

2. State of the Art

During the game of golf it is important to stay adequately hydrated. An average golf course is 5,200 to 7,200 yards long and a golfer can easily walk in excess of three to four miles while playing a round. Many golfers will carry their clubs or use a manual handcart to carry their clubs while playing the game. Moreover, golf is often played during the summer months when it is very hot and a round can take three to four hours. Because of the heat and the extended physical exertion, it is often necessary for a golfer to drink several times during each round.

While some golf courses have numerous watering stations where a golfer can get a drink, there are many courses which have relatively few stations. Additionally, the stations are often spaced at various locations along the golf course and a golfer will often get thirsty when there is not a station nearby.

In an attempt to resolve some of these concerns, a number of individuals have proposed golf bags which have hydration systems built into the golf bag. Typically this includes a bladder or reservoir for liquid such as water or a sports drink, and a tube for transporting the liquid from the bladder to the user. While such golf bags are convenient from the point of providing hydration, they are generally inconvenient because the permanently positioned hydration reservoir may be difficult to clean. Additionally, the hydration system may be permanently disposed in the golf bag—raising the price of the bag and eliminating the possibility of transferring the system to a different golf bag.

There have also been a few embodiments for golf bag hydration systems in which the hydration pack is located outside of the bag. Such systems, however, often involve the pack being located in an inconvenient location or have other limitations which make them difficult for some to use. Thus there is a need for a new golf bag hydration system.

SUMMARY OF THE INVENTION

The present invention involves a golf bag hydration system which includes a hydration bladder, tubing and a control valve for selectively allowing liquid to flow out of the hydration bladder, through the tubing and into the mouth of a user. In accordance with one aspect of the invention, the hydration bladder is sized to fit in a pocket of a conventional golf bag.

In other accordance with another aspect of the present invention, the golf bag hydration system includes a holding sleeve which is removably attachable to a shoulder strap, or handcart associated with a golf bag. The tubing may be selectively slidable with respect to the holding sleeve so that the tubing may be advanced from the holding sleeve when needed for drinking and retracted back into the holding sleeve when the tubing is no longer required.

In accordance with another aspect of the present invention, a storage pack may be provided which releasably attaches to a golf bag. The storage pack may include a tubing inlet, a tubing outlet and a pocket which is of sufficient size to allow the tubing to be coiled or otherwise disposed therein to thereby store excess tubing. In some embodiments, a plurality of inlets/outlets are provided to facilitate tube placement from multiple directions.

In accordance with another aspect of the present invention, the storage pack may also include a cover for selectively covering the open end of a golf bag to thereby protect clubs and other contents of the golf bag during storage or during inclement weather.

In accordance with still another aspect of the present invention, the storage pack may include additional retention mechanisms, such as one or more pockets for holding a pencil, a scorecard and other miscellaneous items, as well as a connector or attachment mechanism, such as a hook and loop fastener (VELCRO®) patch for holding a golf glove to allow the golf glove to dry out while not being worn by the golfer. For example, the storage pack may have a pocket configured for holding a cellular telephone and/or a pocket configured to hold a mobile charger, such as a battery.

In accordance with another aspect of the invention, the golf bag hydration system may include a bladder, a length of tubing for carrying liquid from the bladder to a distal end of the tubing, and a sleeve for slidably holding the distal end of the tubing. The bladder and a portion of the tubing can be held in a removable pack which protects the bladder and allows for storage of a portion of the tubing when not needed.

In accordance with yet another aspect of the invention, the tubing may include an in-ling QCD (Quick Connect/Disconnect) valve which allows the tubing to disconnect to thereby facilitate placement of the tubing in the storage pack and to prevent damage to the tubing in the event that the tubing is suddenly pulled, as may happen, for example if a person is drinking and the golf bag to which the storage pack is attached falls over. The valve also facilitates channeling of the hydration tubing through the storage pack.

BRIEF DESCRIPTION OF THE DRAWINGS

Various embodiments of the present invention are shown and described in reference to the numbered drawings wherein.

Figure 1A:
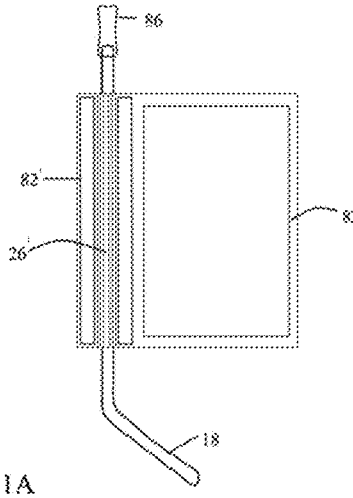
FIG. 1A shows an alternate configuration of a sleeve for holding the hydration tubing.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The skilled artisan will understand, however, that the apparatuses, systems and methods described below can be practiced without employing these specific details, or that they can be used for purposes other than those specifically described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment" or "an embodiment" means that a particular feature, structure, or characteristic described in connection with the embodiment is included in at least one embodiment, but is not a requirement that such feature, structure or characteristic be present in any particular embodiment unless expressly set forth in the claims as being present. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the invention may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present disclosure is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect must be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a spring" or "a pack" may include one or more of such springs or packs, and reference to "the layer" may include reference to one or more of such layers.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range.

Figure 1:
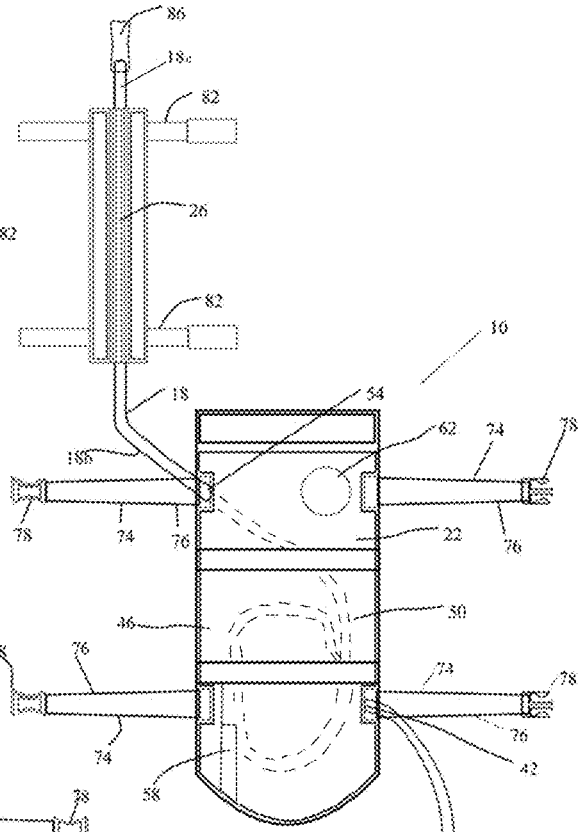
FIG. 1 shows a top view of a golf bag hydration system formed in accordance with one representative embodiment of the present invention.

Turning now to FIG. 1, a top view is shown of a golf bag hydration system, generally indicated at 10. The golf bag hydration system 10, includes a hydration reservoir or bladder 14 and a length of hydration hose or tubing 18 which is designed to carry liquid from the hydration bladder to a user. The golf bag hydration system 10 may also include a storage pack 22 which may be configured for releasable attachment to a golf bag, and tubing guide or sleeve 26 which holds a distal portion of the hydration tubing 18 to make access easier for a user. (As used herein the "proximal" end references an end which is closest to the hydration bladder and "distal" end refers to an end which is most distant from the hydration bladder, i.e. not relative to a user of the system).

The hydration bladder 14 can be fabricated of known materials and may include any of a variety of commercially available hydration bladders which are presently commercially available or which may become available in the future. The hydration bladder 14 may include a liquid cut-off mechanism 30 such that the hydration tubing 18 may be detached from the bladder without liquid leaking out of the bladder. This allows the bladder 14 to be removed from the system for refilling, cleaning and the like without removing the remaining components of the system from a golf bag, etc. The bladder 14 may also include caps or closures 34 which allow selective access to the bladder compartment.

The hydration bladder 14 is preferably sized to fit in a pocket of a conventional golf bag. Thus, for example, the bladder may be about 1 liter in size. However, other sizes may also be used. Additionally, the bladder 14 may be held in a pouch or pack 38 to protect the bladder. The pouch may include conventional protections such as a fold-over flap to allow secure closure while providing easy access. The pouch or pack 38 may be lined with water-proof and/or antimicrobial material to prevent liquid from escaping into the golf bag and to prevent bacterial growth. The pouch or pack 38 and hydration tubing 18 may also include insulation for keeping contents of the bladder 14 cool.

The size and flexibility of the bladder 14 and pouch 38 allow the bladder to be stored in one of several pockets on a conventional golf bag. This is of particular convenience as it allows the golf bag hydration system 10 to be used on the vast majority of golf bags currently in use without modification. It will be appreciated, however, that an additional storage pack designed to hold the bladder and to attach the bladder to a golf bag may also be used.

The bladder 14 may be attached to a proximal portion 18*a* of the hydration hose or tubing 18. The proximal portion 18*a* of the tubing 18 extends from the bladder 14 to an inlet 42 on the storage pack 22. (As will be discussed below, the storage pack 22 may have multiple inlets/outlets). The inlet 42 in the storage pack 22 leads into a pocket, represented by dashed lines 46 wherein excess length of a middle portion the tubing 18 may be stored, such as by being coiled, etc., as represented by dashed lines 50. The inlet 42 may be sufficiently large to allowing the tubing to freely slide or may be sufficiently small that it provides frictional resistance to sliding by the hydration tubing 18.

The storage pack 22 also includes an outlet 54 through which a distal portion 18*b* of the hose or tubing 18 extends. From the storage pack 22, the tubing 18 extends to the sleeve sheath or other retainer 26 which holds the tubing adjacent the distal end of the tubing as will be discussed below.

By holding the middle portion of the tubing 18, the storage pack 22 allows a long hose or tubing to be used—thereby allowing one size to fit a large number of different bag configurations—while keeping excess tubing out of the way so that is not accidentally damaged, becomes tangled, gets in the way of the user or otherwise disrupts the normal function of the golf bag, etc.

The storage pack 22 can also provide several other benefits. For one, the storage pack may include one or more pockets 58 for holding various items, such as a pencil and/or a score card. It may also include a retainer or retention device 62, such as a clip, hook or hook and loop fastener (such as VELCRO® brand hook and loop fastener) for receiving and holding other items such as a glove. It will be appreciated that, between uses, gloves are often misplaced. Additionally, during a round a user often wishes to remove the glove to allow it to dry. If placed in a pocket in the golf bag, a glove will dry very slowly and may provide an unpleasant odor to the bag if left in the pocket long term. If placed in a pocket which is not properly closed, the glove may be lost. Attaching the glove to the retention device 62 allows it to dry in open air while keeping it with the bag so that it is not lost between uses.

Figure 2:
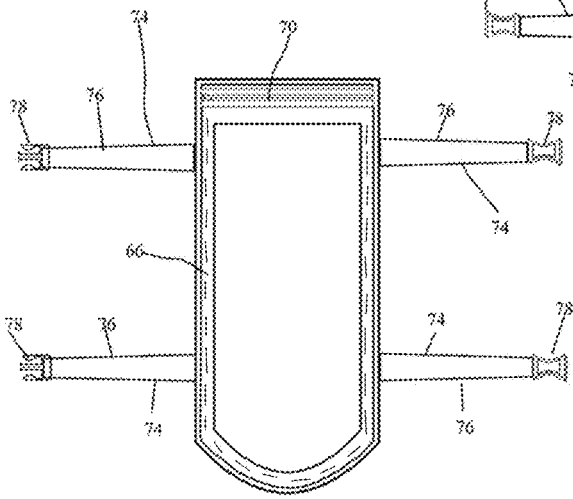
FIG. 2 shows a back view of the storage pack of FIG. 1.

Referring momentarily to FIG. 2, there is shown a back side of the storage pack 22. The storage pack 22 may include a pocket, indicated by dashed lines 66, which holds a cover (See FIG. 3) for covering the open end of a golf bag during storage or inclement weather. A zipper 70 or other closure device may be included to keep the cover in the pocket 66 of the pack 22 when not in use.

The storage pack 22 may also include attachment members 74 for attaching the storage pack to a golf bag. The attachment members 74 shown in FIGS. 1 and 2 are straps 76 with mating buckles 78 at opposing ends. Chords or other attachment members 74 could also be used. Hook and loop fasteners and other fasteners may also be used on the straps 76 to secure them to one another or to the bags.

Figure 8:
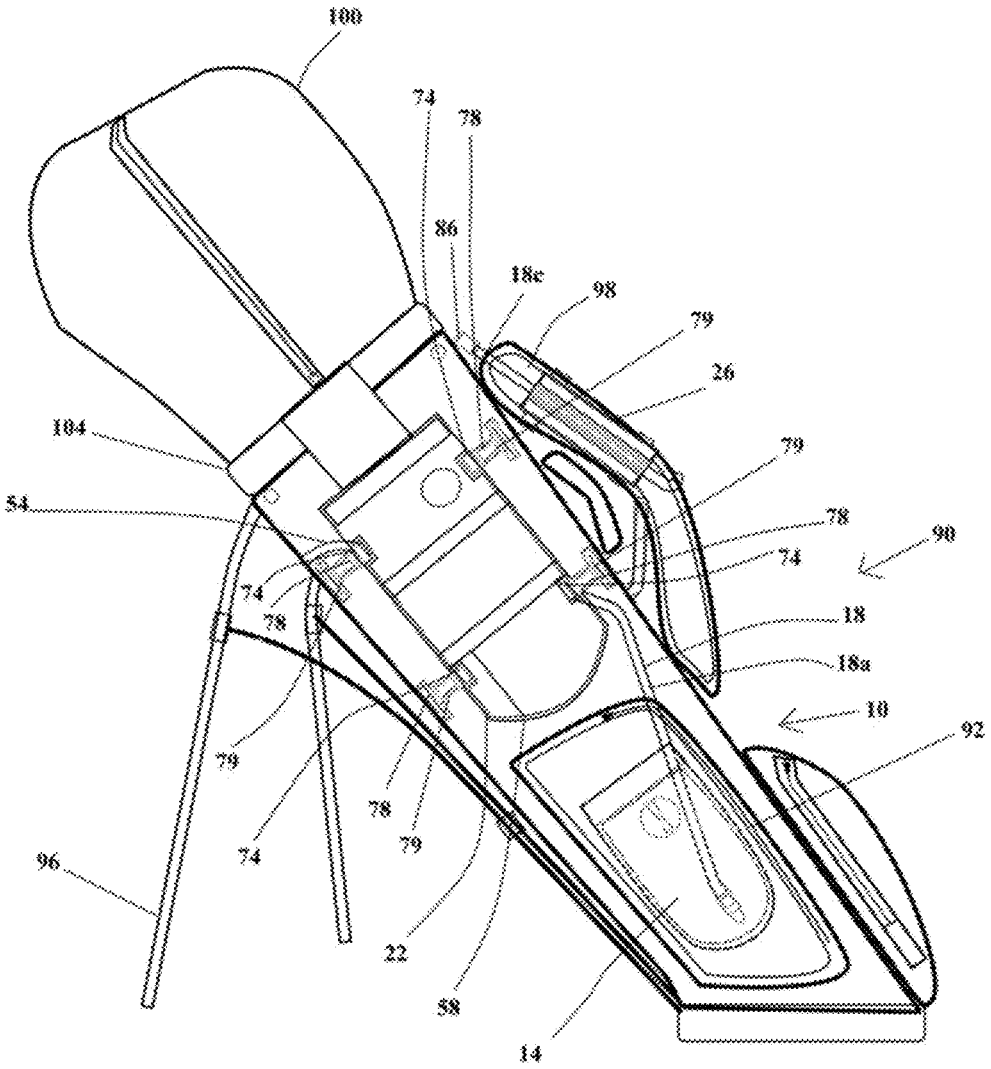
FIG. 8 shows a side view of a golf bag having a hydration system and multi-accessory unit disposed thereon.

The straps 76 may be adjustable to accommodate golf bags of different diameters and typically will be long enough to extend around the golf bag. It will be appreciated, however, that some golf bags have buckles or other devices for attaching items and those structures could be used as well as shown in FIG. 8. Furthermore, all or part of the invention could also be integrated with a golf bag.

The attachment members 74 are advantageous because they allow the hydration system 10 to be attached to and removed from a golf bag very easily. In fact, the hydration system 10 can be easily taken off one golf bag and placed on another golf bag in less than a minute. Thus, a single hydration system can be used by golfer who uses several different golf bags. For example, some golfers will have a cart bag (designed to be used on a handcart and shown below in FIG. 4), a stand bag (which includes a stand for holding the bag at an incline and shown below in FIG. 3) and a Sunday bag which is designed to hold a few clubs for playing a quick round or for practice putting and driving. The present invention may allow a single hydration system to be used with all three bags.

FIG. 1 also shows the distal portion 18*b* of the tubing 18 and a guide or sleeve 26 disposed therealong. The function of the sleeve 26 is to hold the distal portion of the tubing 18, channeling it so that the tubing does not get in the way while keeping the tubing readily available for the user. The sleeve 26 may include attachment members 82, such as straps lined with hook and loop fastener, etc., to allow the straps to engage one another. The attachment members 82 allow the sleeve 26 to be attached to a shoulder strap of a golf bag so that a bite valve 86 or other control mechanism at the distal end 18*c* of the tubing is positioned near a user's head. The sleeve 26 may be attached to the shoulder strap if the bag only includes one shoulder strap, and to either the right or the left shoulder strap if the bag has both, depending on the preference of the user.

The guide or sleeve 26 need not completely enclose the distal portion of the tubing 18 adjacent to the distal end 18*c*. It is desirable, however, that the sleeve allow the distal end 18*c* to extend out of the sleeve when wanted, and pushed back at least partially into the sleeve after a user has taken a drink. It is also desirable that the sleeve 26 provide some resistance to advancement of the tubing so that the length of tubing adjacent the distal end stays in the sleeve until pulled on by the user. If desired, a biasing element, such as a spring or rubber-band could be used to pull the distal end back into the sleeve when not in use. FIG. 1A shows an alternate embodiment of the sleeve or guide 26, which uses a fold-over flap which engages hook and loop fastener to form the attachment members 82'

Figures 3, 3A:
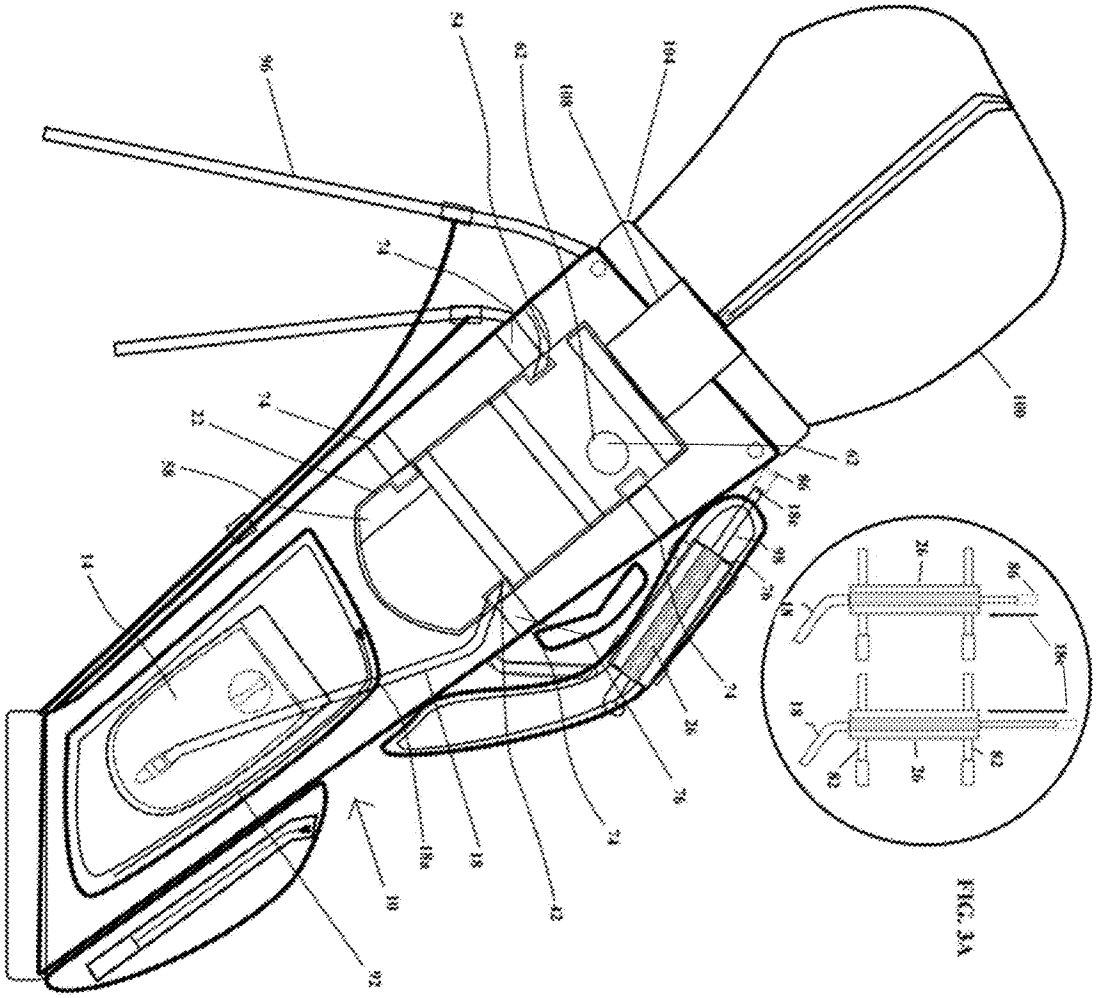
FIG. 3 shows a side view of a golf bag having the golf bag hydration system of FIG. 1 attached thereto.
FIG. 3A shows a close-up view of the distal end of the tubing (relative to the hydration bladder) and the holding sleeve with the tubing in extended and retracted positions.

Turning now to FIG. 3, there is shown a side view of a conventional golf bag, such as a stand bag, generally indicated at 90, with the hydration system 10 of the present invention mounted thereon. The hydration system 10 is the same as that discussed previously and is numbered accordingly.

The hydration bladder 14 is disposed in a pocket 92 on the bag 90. It will be appreciated that golf bags typically have one or more pockets large enough to fit the hydration bladder 14. If the back lacks such a pocket or the user prefers to use the pocket for holding other things (such as a windbreaker), a second storage pack similar to storage pack 22 could be used to hold the bladder 14.

The proximal portion 18*a* of the tubing 18 extends from the hydration bladder 14 and out through pocket 92. Typically this is accomplished by not zipping the pocket all the way closed to allow for the tubing to pass through the remaining opening in the unzipped portion of the zipper.

The tubing 18 extends to the inlet 42 on the storage pack 22 which is held onto the golf bag 90 by the straps 76 forming the attachment members 74. The storage pack 22 is on the side of the golf bag 90 where it is out of the way and does not interfere with retrieving clubs or using the stand 96. (The pack 22 can also be positioned on the bag between the legs of the stand without interfering with the stand). The storage pack 22 also provides one or more pockets 58 for the pencil/score card and other small items, the retention device 62 for attaching the glove, and a cover (discussed below). Furthermore, as will be discussed below, a plurality of inlets and outlets may be present and one pocket may be configured to hold a mobile charging device.

As shown in FIG. 3, the tubing 18 extends out of the outlet 54 adjacent the top of the storage pack 22 and around the back of the golf bag 90. Such might be done, for example, if the storage pack 22 was disposed on the right side of the golf bag 90, but the user wanted the sleeve 26 and distal end 81*c* of the tubing 18 to be held on the left shoulder strap 98 of the golf bag. (On a golf bag with a single shoulder strap, the tubing 18 could extend in either direction depending on how the user likes to carry the bag.) If the user wanted the tubing 18 attached to the right shoulder strap, he or she would need to merely push a few extra inches of the tubing back into the storage pack 22 through outlet 54 to keep the tubing from getting tangled or otherwise getting in the way and attach the sleeve 26 on the right shoulder strap.

The distal end 18*c* of the tubing 18 and the bite valve 86 are in an extended position as shown in FIG. 3 so that a user carrying the bag 90 could simply turn his or her head to engage the bite valve. Alternatively, the distal end could be extended further so that the user places the distal end in his or her mouth with his or her hand. FIG. 3A shows the ability for the distal end 18*c* to be extended from or pushed back into the sleeve 26, to hereby control the distal portion of the tubing and keep it from getting in the way.

FIG. 3 further shows the golf bag cover 100 which may be stored in the storage pack 22, and which may be sewn or otherwise attached to the storage pack When storing or transporting a golf bag, it is often desirable to cover the open end of the bag to protect the clubs. Likewise, during inclement weather it is often preferable to keep the clubs covered when possible. The storage pack 22 allows a user to add a cover 100 to a golf bag 90 which lacks a cover. The cover 100 can be made of nylon or other suitable materials and can have an expandable opening 104 (such as the use of elastic or a drawstring) to accommodate golf bags of various diameters. When not in use, the cover 100 can be folded or rolled up and disposed back in the storage pack 22. Additionally, the cover 100 may have a tether 108 to keep it from getting separated from the storage pack, and a zipper to allow access to the clubs if needed. By attaching the cover 100 to the pack 22, the cover cannot get lost and will not blow away in windy conditions.

Figure 4:
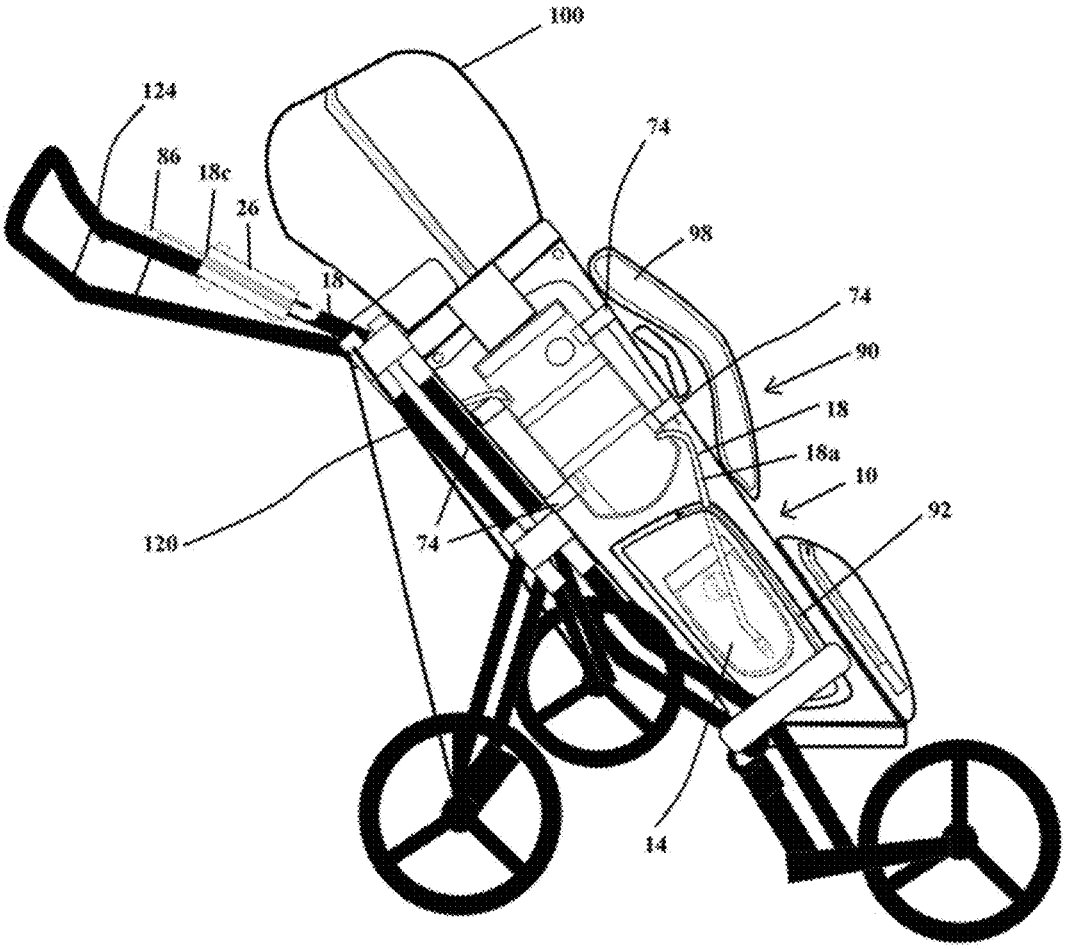
FIG. 4 shows a side view of a golf bag hydration system on a golf bag being carried on a hand cart in accordance with the teachings of the present invention.

Turning now to FIG. 4, there is shown a golf bag 90*a* (such as a cart bag) mounted on a hand cart 120. The golf bag hydration system 10 is mounted on the golf bag 90*a* in the same manner, except that hydration tubing 18 extends up beyond the top of the golf bag and the sleeve 26 is mounted on the handle 124 or frame of the hand cart 120 rather than being mounted on the shoulder strap 98. This allows the person pushing the cart 120 to easily access the distal end 18*c* of the hydration tubing 18 and take a drink while pushing or standing next to the hand cart 120. The mounting of the golf bag hydration system 10 on the golf bag 90*a* is otherwise the same in FIGS. 3 and 4 and FIG. 4 has been numbered in accordance with the description regarding FIG. 3.

One advantage of the golf bag hydration system is that it can be mounted on various differently configured golf bags and at different locations on the golf bag. For example, in FIG. 3, the storage pack 22 could have been mounted so that it was on the back side of the bag between the legs of the stand 96. The golf bag hydration system 10 can be adapted to different configurations and different desires of the user.

Figure 5:
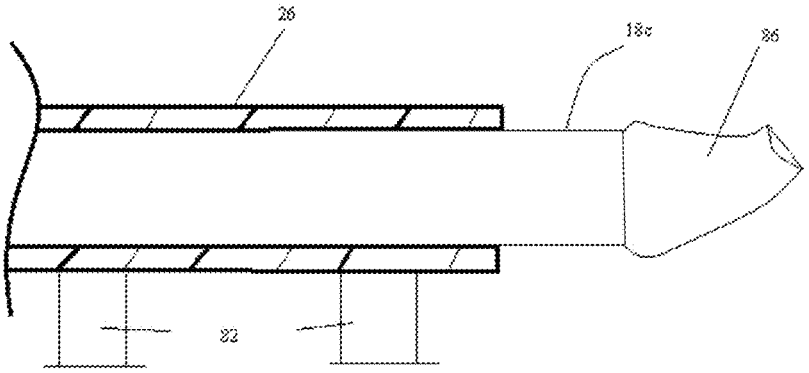
FIG. 5 shows a cross-sectional view of the guide or sleeve shown in FIG. 3A.

Turning now to FIG. 5, there is shown a cross-sectional view of the sleeve or guide 26. The sleeve 26 may be made from a variety of materials, including various fabrics, neoprene and rubber. The sleeve 26 is designed to frictionally engage the distal end 18*c* of the hydration tubing 18 adjacent the bite valve 86. The engagement may be such that the tubing 18 will slide relative to the material in the sleeve 26 when pulled or pushed by the user, but will generally move little, if at all, when not pulled by the user, to thereby keep the tubing from overextending and getting in the way of the user, or retracting back into the channel where it is difficult to reach.

Figure 6:
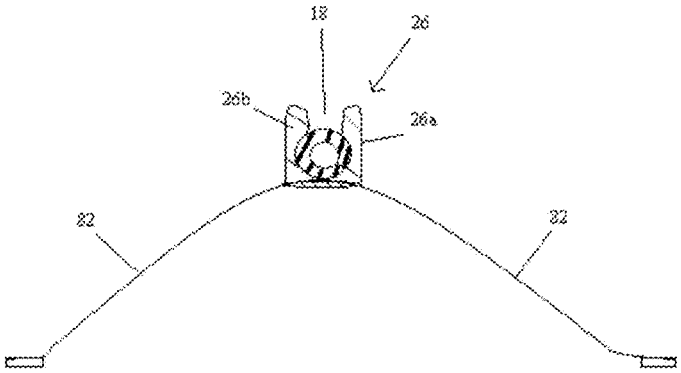
FIG. 6 shows an end view of an alternate configuration of a guide which holds the distal end of the hydration tubing.

While a sleeve 26 works well, it will be appreciated that other types of guides may be used. For example, in FIG. 6 there is shown a cross sectional view of the tubing 18 mounted between arms 26*a*, 26*b* which form a guide, generally indicated at 26'. As with the sleeve of the prior embodiment, the guide 26' may engage the tubing 18 in such a manner that it limits the ability of the tubing to advance or retract on its own, while allowing the tubing to be pulled outwardly from the guide or pushed back into the guide depending on the needs of the user. Either the sleeve 26 or other guide 26' can be attached to a shoulder strap or to a golf cart by the attachment members 82.

Figure 7A:
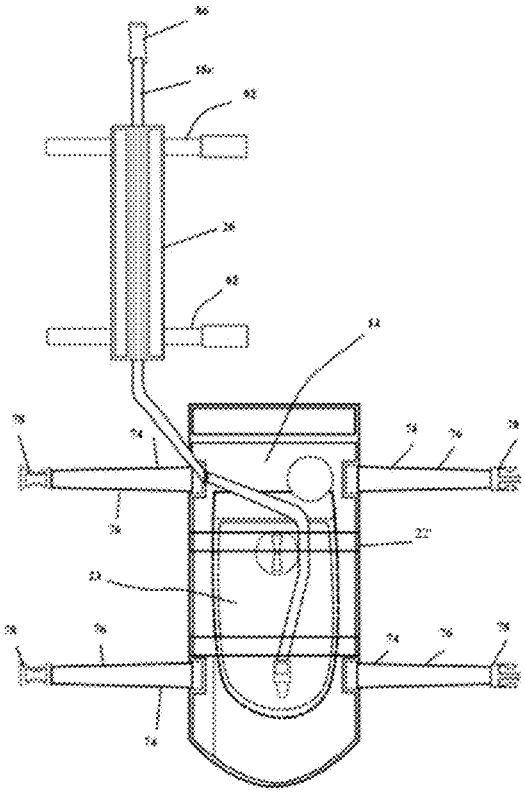
FIGS. 7A and 7B show a top view and a bottom view, respectively, of an alternate configuration of a golf bag hydration system and multi-accessory system.
Figure 7B:
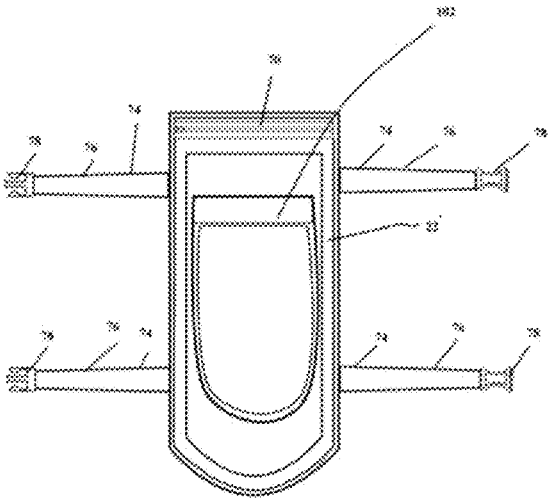

Turning now to FIGS. 7A and 7B, there is shown top and bottom views of another embodiment of the invention. A bladder 14' may be connected to a length of tubing 18. The distal end 18*c* of the tubing may include a bite valve 86 or other control mechanism for regulating flow. The bladder 14' may be held in a pocket 102 (FIG. 7B) of a pack 22' which includes attachment members 74 for attaching the pack to a golf bag. The attachment members may include, for example, straps 76 and buckles 78.

The pack 22' may include a pouch 23 for holding an unneeded length of the hydration tubing 18, such as in a coil, etc. The tubing can then extend from the pouch 23 to a sleeve or guide 26 as discussed previously. The portions of the guide 26 may be similar to the sleeve/guide discussed above and are numbered accordingly. The pack 22' may also include additional pockets for cards, pencils and the like.

The pack 22' is advantageous in that the bladder 14' and the tubing 18 are held in a single pack making transport easier. Such a configuration also allows the user to use the pockets on the golf bag for other things, such as a jacket, extra balls, etc. The challenge with such a configuration, however, is that it becomes more difficult for the bladder, etc., to conform to the curvature of the exterior of the golf bag without interfering with its proper use and it may interfere with the legs of the stand fully retracting. Thus, such a configuration can be more difficult to use than is placing the bladder in a pocket already formed on the golf bag.

Turning now to FIG. 8, there is shown an alternate configuration of a golf bag hydration system and multi-accessory system, generally indicated at 10', which is similar to the system discussed above and numbered accordingly. Instead of the attachment members 74' including straps which extend around the golf bag 90 and engage one another, the attachment members 74' include buckles 78' which engage buckles 79 on the bag. Those of skill in the art will appreciate that many golf bags include buckles by which items may be attached to the bag. For such configurations, the alternate attachment members 74 shown in FIG. 8 may be used.

Figure 9:
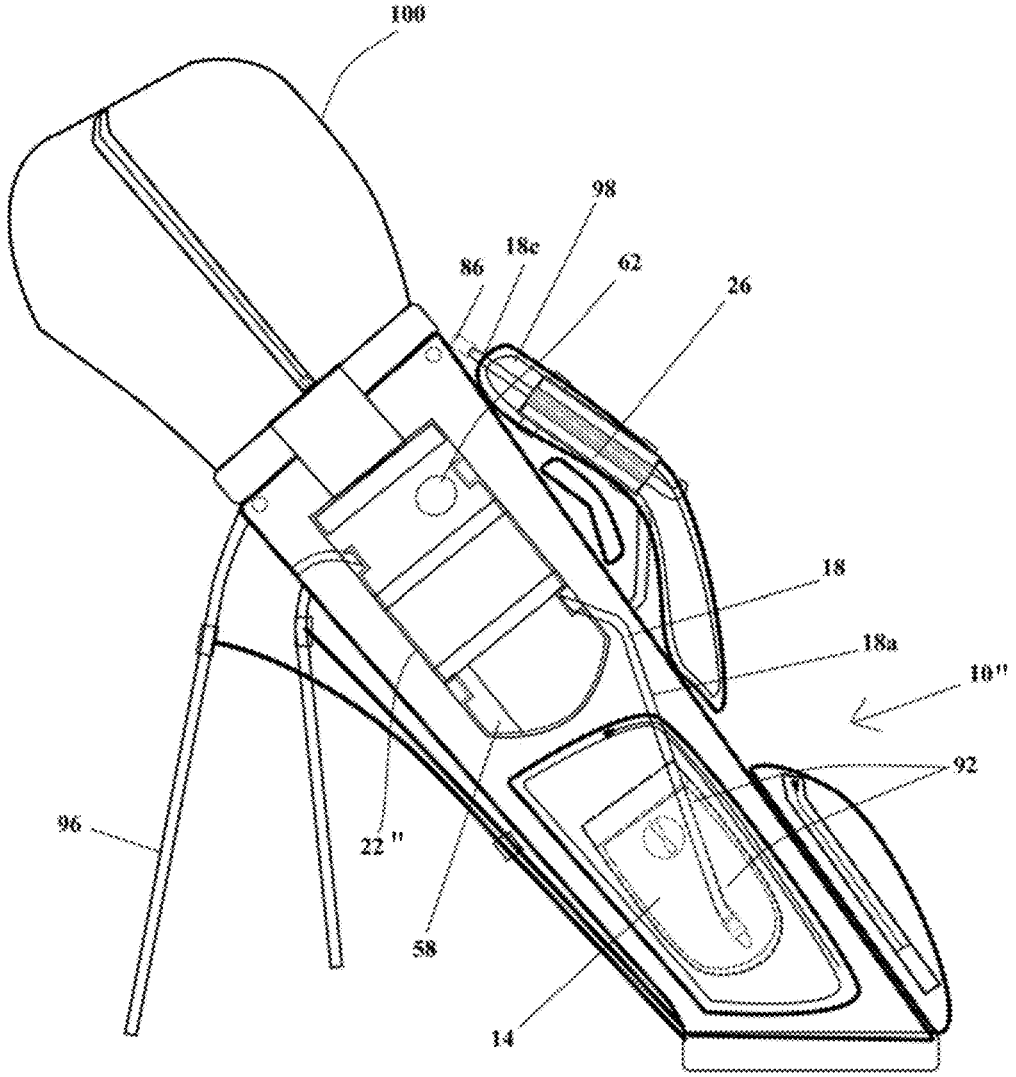
FIG. 9 shows a golf bag with a hydration system disposed therein.

FIG. 9 shows a side view of golf bag 90" in accordance with another aspect of the invention. The golf bag 90" includes a hydration and multi-accessory system 10". Rather than having the pack 22" be removable from the bag, the pack is formed into the bag to hold an unused portion of the tubing and to provide pockets for pencils, scorecards, a cover 100 and the like. Otherwise, the system 10" and the bag 90 may be generally the same as discussed above and are numbered accordingly. While having the pack 22 be formed as part of the bag 90 is disadvantageous in that it is not movable from bag to bag, it still provides the benefit of tubing control and the bladder 14 can be removed from the bag more easily than many prior art configurations. Other portions of the hydration system 10" are similar to those discussed above and are number accordingly for brevity.

Figure 10B:
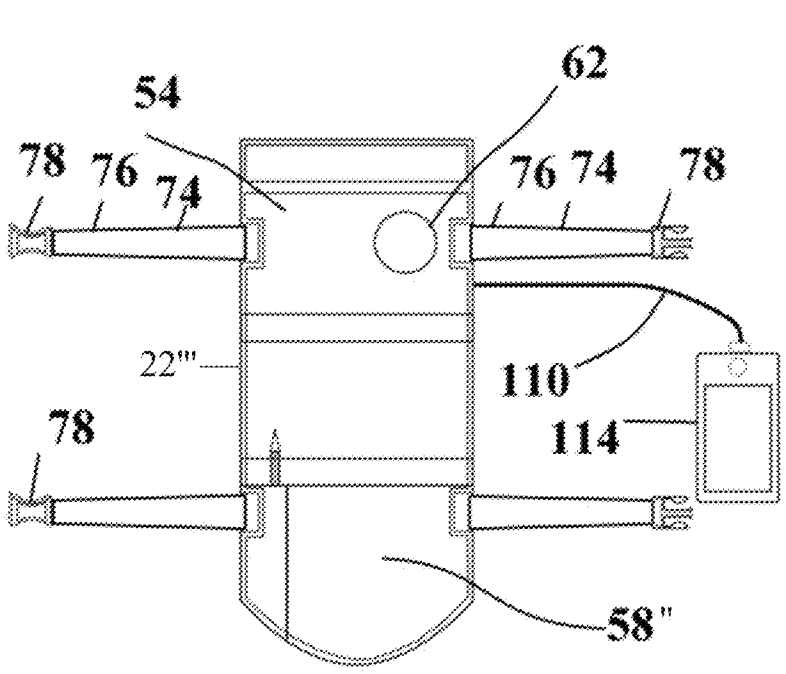
FIG. 10B shows a top view of the storage pack of FIG. 10A, which a pocket for holding a cellular telephone or other electronic device.
Figure 10A:
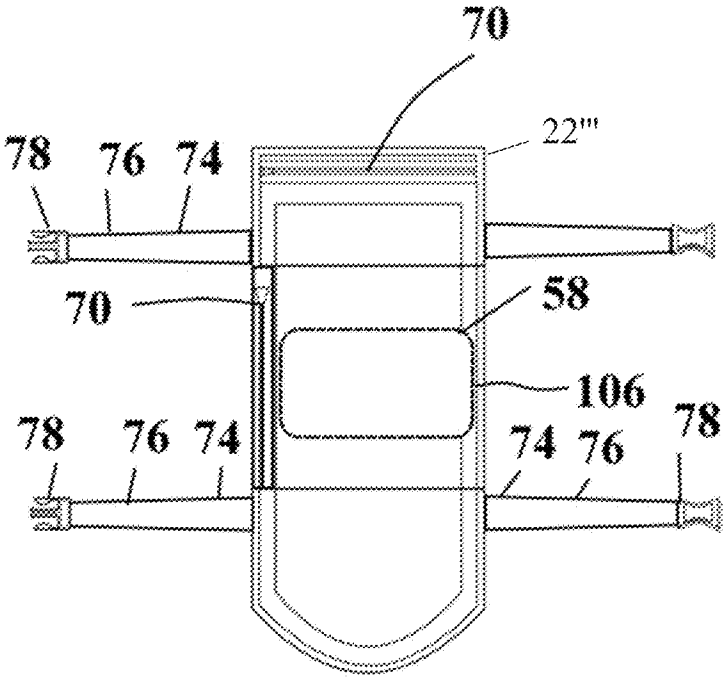
FIG. 10A shows a bottom view of a configuration of a storage pack similar to that shown in FIGS. 1-8, wherein the storage pack includes a mobile charger.

Turning now to FIGS. 10A and 10B, there are shown bottom views and top views, respectively, of an alternate configuration of a storage pack 22'". The storage pack 22'" may be similar to that discussed in any of the previous configurations. The storage pack 22'", however, also includes a pocket 58' for holding a mobile charger 106. There has been a significant proliferation of the use of smart phones and other digital devices on golf courses. For example, a smart phone may have a map of the course and information about various hazards loaded thereon. The smart phone may also be used as a camera, as many golf courses are extremely picturesque. There are also a number of applications which allow the user to better estimate the his or her distance from the hole—such as GPS applications. Other digital devices may also be used.

Because of the length of a game of golf, smart phones and other digital devices may run out of power during a round. To prevent this from happening, the storage pack 22'" may include the mobile charger 106 and a cable 110 (e.g. a usb cable) which extends out of a small opening in the pocket and allows the electronic device 114 to be charged during the round of golf. For example a cellular telephone may be connected to the cable 110 and then disposed in a pocket 58" on the front of the storage pack 22'". While the user plays the device is charging, thereby keeping it ready to take a picture of a picturesque scene (or a particular embarrassing shot by a golfing companion), ready to determine the distance to the hole, etc. Many mobile chargers are available which will completely recharge a telephone 3-6 times before the mobile charger needs to be recharged. Moreover, even if the user simply had a cellular telephone, the user can recharge it while playing golf to ensure that it is fully charged for user when the round is done.

While the pocket 58" which holds the mobile charger 106 may be anywhere on the storage pack 22'", it is preferred that it be on the underside. This protects the mobile charger in the event of rain or other environmental conditions.

The remaining portions of the storage pack 22'" may be the same or similar to the embodiments discussed above and are therefore numbered accordingly for brevity. It will be appreciated that the configuration shown in FIGS. 10A and 10B may be used in place of the storage packs 22 or 22' and may include any of the features thereof.

Turning now to FIGS. 11A through 11F, there are shown front views of an alternate embodiment of the storage pack 22"" as may be used with the hydration systems above. Rather than having a single inlet and a single outlet (such as 42 and 54 above), the storage pack is formed with a plurality openings 54'. The openings 54' may be positioned, for example, adjacent the attachment members 74. The plurality of openings allow the hydration tubing to enter and exit the storage pack 22"" in a variety of different orientations. This allows a single storage pack 22"" to be used for a wide variety of placements and configurations to accommodate a wide variety of bag configurations and golfer preferences.

Figures 11A, 11B, 11C, 11D, 11E, 11F:
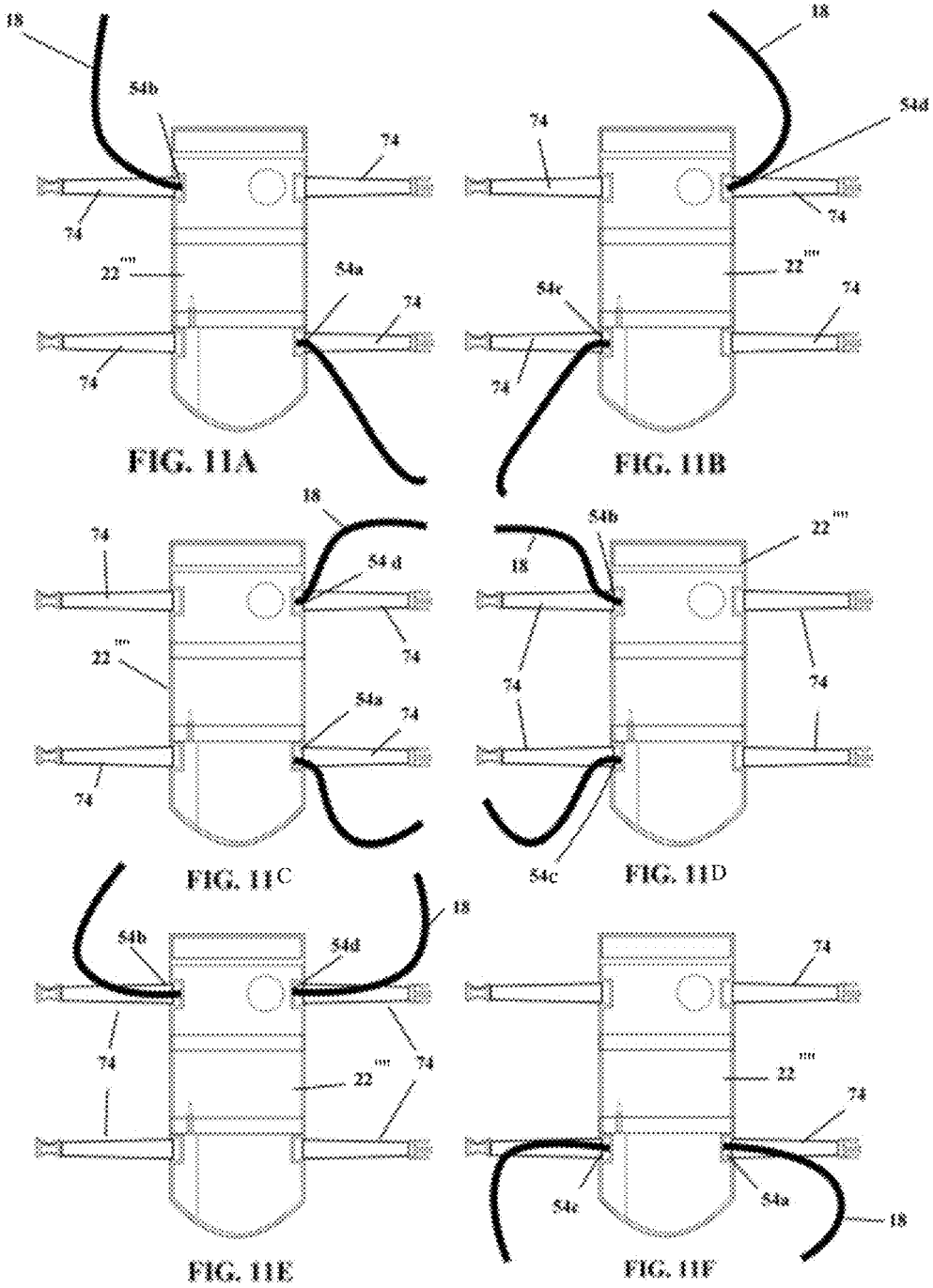
FIGS. 11A-11F show an alternate embodiment of the storage pack of the hydration system and four different ways of passing the hydration tube into and out of the pack.

Thus, for example, in FIG. 11A, the tubing 18 enters the storage pack 22"" through a lower right opening 54*a* and exits through and upper left opening 54*b*. In FIG. 11B, the, tubing 18 enters the storage pack 22"" through a lower left opening 54*c* and exits through and upper right opening 54*d*. In FIG. 11C, the tubing 18 enters through lower right opening 54*a* and exits through opening 54*d*. In FIG. 11D, the tubing 18 enters through opening 54*c* and exits through opening 54*b*. In FIG. 11E, the tubing 18 enters through opening 54*b* on the upper left and exits through opening 54*d* on the upper right. In FIG. 11F, the tubing 18 enters through opening 54*c* on the lower left and exits through opening 54*a* on the lower right. It will be appreciated that the tubing could be disposed in the reverse direction for all of the above.

It will be appreciated that there are multiple aspects to the invention of the present disclosure. For example, a hydration system in accordance with the present invention may include a hydration bladder; hydration tubing connectable to the hydration bladder; and a storage pack having a pocket formed therein for holding a length of the hydration tubing. The hydration system may further include the storage pack having at least one inlet and at least one outlet disposed in communication with the pocket and wherein the tubing extends through the inlet, the pocket and the outlet; the storage pack further having at least one attachment member for attaching the storage pack to a bag; the at least one attachment member having a plurality of straps which extend from the storage pack; the storage pack further comprising a cover removably disposed in the storage pack; a sleeve disposed on the hydration tubing distal from the storage pack; the sleeve further comprising at least one attachment member for attaching the sleeve to shoulder strap of a bag; the hydration tubing having a distal end having a valve thereon, and wherein the distal end is movable into and out of the sleeve; the hydration bladder being disposed in a protective pouch; the storage pack including a retention member for holding a glove to the outside of the storage pack; the retention member comprises a portion of hook and loop fastener attached to an outside of the storage pack; and/or a cable for connecting a mobile charger to an electronic device, and at least one pocket configured for holding a mobile charger, and combinations thereof.

The invention may also include a method of adding a hydration system to a golf bag including selecting a golf bag; and attaching a hydration system having a hydration bladder, hydration tubing and storage pack to the golf bag, such that at least a portion of the hydration tubing is disposed in the storage pack. The method may further include: attaching a sleeve to the golf bag such that the hydration tubing extends through the sleeve; attaching the sleeve to a shoulder strap of the golf bag; the golf bag being disposed on a hand cart and wherein the method comprises attaching a sleeve to the hand cart such that the hydration tubing extends through the sleeve; the bladder is disposed in a pocket on the golf bag and the tubing is coiled in the storage pack; and/or disposing a mobile charger in the storage pack, and combinations thereof.

A golf bag hydration system of the present invention may include a hydration bladder for holding a liquid; tubing having a distal and an a proximal end attachable to the hydration bladder for carrying liquid from the hydration bladder to a remote location; and a guide, attachable to a golf bag for holding the distal end of the tubing adjacent to the golf bag, the tubing being slidable relative to the guide. The system may also include or more of: the distal end of the tubing being slidable relative to the sleeve; a storage pack having at least a portion of the tubing coiled therein; the storage pack being formed as part of the golf bag; and/or the storage pack including a plurality of attachment members for holding the storage pack to the golf bag, and combinations thereof.

A golf bag in accordance with one aspect of the invention may include an open upper end for receiving golf clubs and a hydration system is attached to the golf bag, the hydration system comprising a hydration bladder, a hydration tubing, a storage pack for holding a portion of the hydration tubing, the storage pack being attached about the exterior of the golf bag, and a sleeve attachable to the golf bag, the hydration tubing being extendable from the sleeve. The golf bag may further include one or more of the hydration bladder is disposed in a pocket of the golf bag; the storage pack being attached to the golf bag by straps extending around the golf bag; the sleeve being mounted to the shoulder strap of the golf bag; and/or the storage pack having a cover disposed therein, and combinations thereof.

Thus there is disclosed a golf bag hydration system. Those skilled in the art will appreciate in light of the present disclosures that multiple modifications could be made to the components to facilitate attachment and use of the system to various types of golf bags and other athletic bags. The appended claims are intended to cover such modifications.

What is claimed is:

1. A hydration system comprising:

a hydration bladder;

flexible hydration tubing connectable to the hydration bladder; and a storage pack having a pocket formed therein for holding a length of the flexible hydration tubing, the storage pack having four openings which serve as inlets and/or outlets for the hydration tubing, the four openings being disposed on different locations of the storage pack such that the flexible hydration tubing may be passed through the openings in a variety of configurations based on the location of the storage pack relative to the location of the hydration bladder, wherein the flexible hydration tubing slidably passes through one of the openings so that a length flexible hydration tubing between the hydration bladder and the storage pack can be adjusted based on a distance between the hydration bladder and the storage pack.

2. The hydration system of claim 1, wherein the storage pack further includes at least one attachment member for attaching the storage pack to a bag.

3. The hydration system of claim 2, wherein the at least one attachment member includes a plurality of straps which extend from the storage pack.

4. The hydration system of claim 1, wherein the storage pack further comprises a golf bag cover removably disposed in the storage pack.

5. The hydration system of claim 1, further comprising a sleeve disposed on the hydration tubing distal from the storage pack and wherein the sleeve further comprises at least one attachment member for attaching the sleeve to shoulder strap of a bag.

6. The hydration system of claim 1, further comprising a sleeve disposed on the hydration tubing distal from the storage pack and wherein the flexible hydration tubing includes a distal end having a valve thereon, and wherein the distal end is movable into and out of the sleeve.

7. The hydration system of claim 1, wherein the hydration bladder is disposed in a protective pouch.

8. The hydration system of claim 1, wherein the storage pack includes a retention member for holding a glove to the outside of the storage pack.

9. The hydration system of claim 8, wherein the retention member comprises a portion of hook and loop fastener attached to an outside of the storage pack.

10. The hydration system of claim 1, further comprising a cable for connecting a mobile charger to an electronic device, and at least one pocket configured for holding the mobile charger.

11. The hydration system of claim 4, wherein the golf bag cover has an open end sized to fit over an open end of a golf bag to protect contents of the golf bag.

12. The hydration system of claim 11, wherein the golf bag cover has a zipper to allow access to the clubs in the golf bag while the cover remains in place.

13. The hydration system of claim 1, wherein the hydration system has a releasable attachment member which is selectively attachable to and removable from a shoulder strap on a golf bag.

14. The hydration system of claim 4, wherein the golf bag cover is attached to the storage pack.

15. A method of adding a hydration system to a golf bag, the method comprising:

selecting a golf bag; and attaching a hydration system having a hydration bladder, flexible hydration tubing and a storage pack to the golf bag with the storage pack and the hydration bladder being spaced apart from one another and connected by flexible hydration tubing which extends from the hydration bladder to the storage pack, such that at least a portion of the flexible hydration tubing is disposed in the storage pack and may be slid out from the storage pack to allow a greater distance between the storage pack and the hydration bladder; and wherein the storage pack has four openings with a plurality of openings at one end and at least one opening on an opposing end the storage pack, wherein the flexible hydration tubing may be passed through the openings in a variety of configurations based on the location of the storage pack to the hydration bladder and a shoulder strap of the golf bag and wherein the method comprises selecting one of the of openings in the storage pack for passing the flexible hydration tubing through based on the location of the hydration bladder disposed in the bag.

16. The method of claim 15, wherein the the flexible hydration tubing extends out of one opening of the four openings; and further comprising attaching a sleeve to the golf bag such that the flexible hydration tubing extends through the sleeve.

17. The method according to claim 16, wherein the method comprises attaching the sleeve to a shoulder strap of the golf bag, the sleeve holding a distal portion of the flexible hydration tubing adjacent the shoulder strap of the golf bag.

18. The method according to claim 15, wherein the golf bag is disposed on a hand cart and wherein the method comprises attaching a sleeve to the hand cart such that the flexible hydration tubing extends through the sleeve.

19. The method according to claim 15, wherein the bladder is disposed in a pocket on the golf bag and the flexible hydration tubing is coiled in the storage pack remote from the pocket.

20. The method according to claim 15, further comprising disposing a mobile charger in the storage pack.

21. A golf bag hydration system comprising:

a hydration bladder for holding a liquid;

tubing having a distal end and a proximal end attachable to the hydration bladder for carrying liquid from the hydration bladder to a remote location;

a guide, attachable to a golf bag for holding the distal end of the tubing adjacent to the golf bag, the tubing being slidable relative to the guide; and a storage pack having at least a portion of the tubing coiled therein and four openings, the tubing being slidable relative to the storage pack at an inlet of one of said openings of the four openings on the storage pack so as to enable a user to adjust a relative position between the hydration bladder and the storage pack and wherein the flexible hydration tubing may be passed through a plurality of said openings in a variety of configurations based on the location of the storage pack to the hydration bladder.

22. The golf bag hydration system of claim 21, wherein the distal end of the tubing is slidable relative to the guide.

23. The golf bag hydration system of claim 21, wherein the storage pack is formed as part of a golf bag.

24. The golf bag hydration system of claim 21, wherein the storage pack includes a plurality of attachment members for holding the storage pack to a golf bag.

* * * * *